US006454427B1

(12) United States Patent
Chen

(10) Patent No.: US 6,454,427 B1
(45) Date of Patent: Sep. 24, 2002

(54) ILLUMINATING UTILITY KNIFE WITH EASY-ACCESS SPARE BLADE DRAWER

(76) Inventor: Kun-Chen Chen, No. 6, Lane 609, Sec. 1, Chung-Shan Rd., Ye-Her Li, Tachia Chen, Taichung Hsien (TW)

( * ) Notice: Subject to any disclaimer, the term of this patent is extended or adjusted under 35 U.S.C. 154(b) by 0 days.

(21) Appl. No.: 09/721,931

(22) Filed: Nov. 27, 2000

(51) Int. Cl.[7] ..... B25B 23/18

(52) U.S. Cl. ..... 362/119; 362/120; 362/207; 362/208; 7/118; 7/119; 30/125; 16/111.1

(58) Field of Search ..... 362/119, 120–190, 362/207, 208, 253; 7/118, 119, 135, 160, 163, 168; 30/125, 143, 535; 16/111.1

(56) References Cited

U.S. PATENT DOCUMENTS 5,430,952 A * 7/1995 Betts ..... 33/760
5,459,647 A * 10/1995 Betts ..... 362/109
5,713,656 A * 2/1998 Lin ..... 362/119
5,916,277 A * 6/1999 Dallas ..... 7/128
6,041,505 A * 3/2000 Chen ..... 30/123
6,273,582 B1 * 8/2001 Taggart et al. ..... 362/119
6,286,745 B1 * 9/2001 Ackeret ..... 227/134

* cited by examiner

*Primary Examiner*—Sandra O'Shea
*Assistant Examiner*—David V. Hobden
(74) *Attorney, Agent, or Firm*—Rosenberg, Klein & Lee

(57) ABSTRACT

An illuminating utility knife has an easy-access to spare blades contained therein. The knife has a housing made up of a first cover and a second cover coupled together and fastened by at least one screw. A blade is slidably contained in the housing. The utility knife of the invention can be used in dim light because an illuminating device is provided in the knife. The illuminating device includes a bulb installed near the blade, a battery chamber defined in the housing for containing at least one battery, and a switch used for actuating the bulb. Additionally, a spare blade drawer is provided and slidably contained in a passage defined in the housing. At least one spare blade is stored in the spare blade drawer and therefore is easy to be taken out for use.

4 Claims, 5 Drawing Sheets

ILLUMINATING UTILITY KNIFE WITH EASY-ACCESS SPARE BLADE DRAWER

BACKGROUND OF THE INVENTION

1. Field of the Invention

The invention relates to a utility knife, especially to a utility knife having an illuminating device and wherein the spare blades thereof are easily accessible from the body of the knife.

2. Description of Related Art

Shown in FIG. 5 is an exploded view of a present utility knife. The knife has a housing including a pair of covers (40) coupled together and fastened by a screw (45). There are two sections in the housing: a front room and a rear room (43). A blade (41) is slidably contained in the front room and installed on a control assembly (42). The control assembly (42) has a button which protrudes out from the housing. By manipulating the button, a user can move the blade (41) to protrude from or retract into the housing. One or more spare blades (44) are contained in the rear room (43).

This kind of conventional utility knife has two drawbacks. One drawback is that the spare blades (44) are contained in the rear room (43) and can only be taken out for use after the screw (45) is removed. If the spare blade (44) is taken out for use due to the original blade being blunt etc, it is very inconvenient to remove the screw (45), take out the spare blade (44), and then install the screw (45) again.

The other drawback is that the conventional utility knife does not have an illuminating device and under dimly-lit working conditions, such kind of utility knife is inconvenient.

SUMMARY OF THE INVENTION

The main object of the invention is to provide a utility knife having an illuminating device being able to help a user work in a dimly-lit environment with the knife.

Another object of the invention is to provide a utility knife wherein the spare blades of which are easily accessed from a body of the knife, thus bringing much convenience for a user.

Other objects, advantages and novel features of the invention will become more apparent from the following detailed description when taken in conjunction with the accompanying drawings.

DETAILED DESCRIPTION OF THE PREFERRED EMBODIMENT

Figure 1:
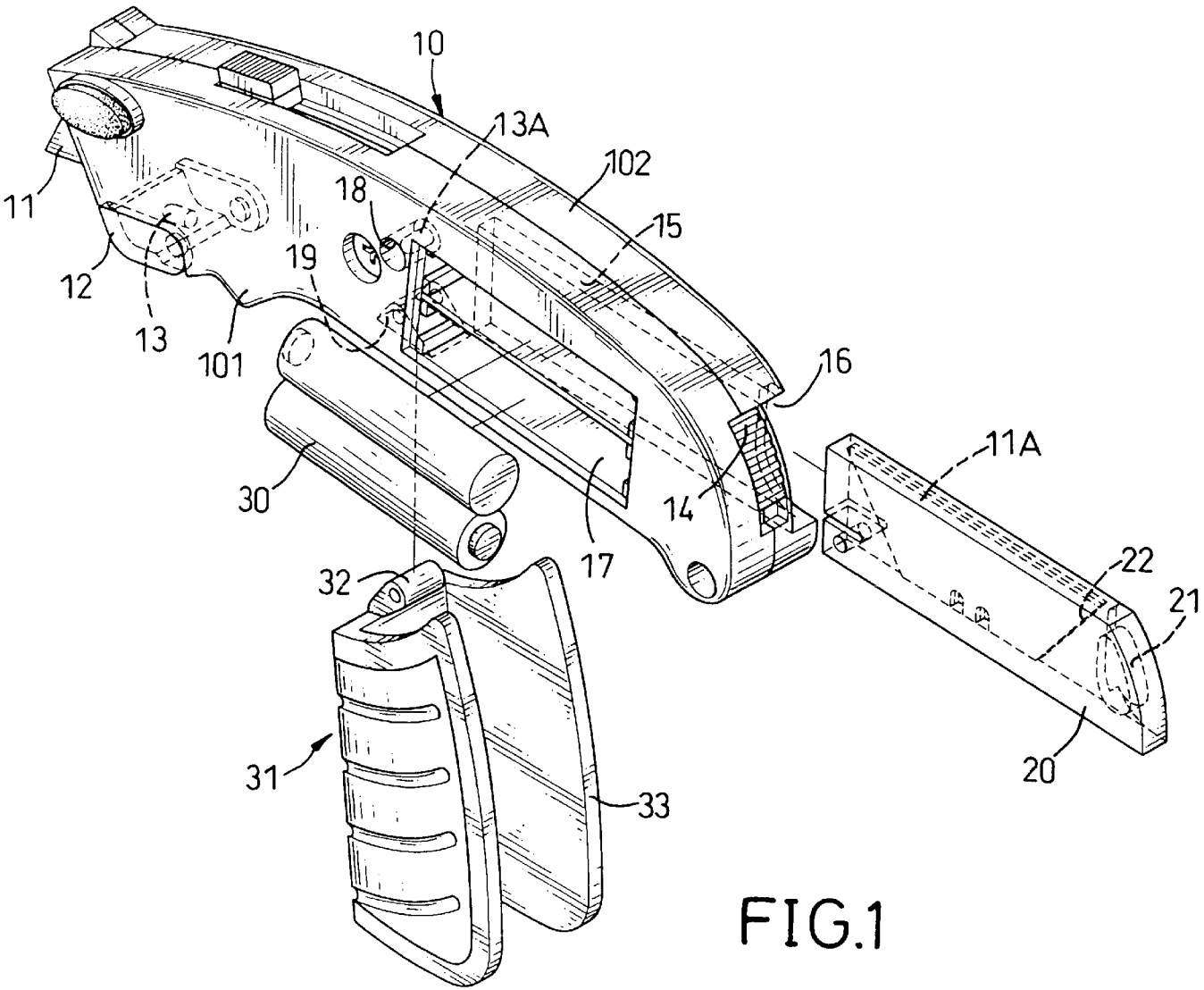
FIG. 1 is an exploded perspective view of an illuminating utility knife with an easy-access spare blade drawer in accordance with the invention.
Figure 2:
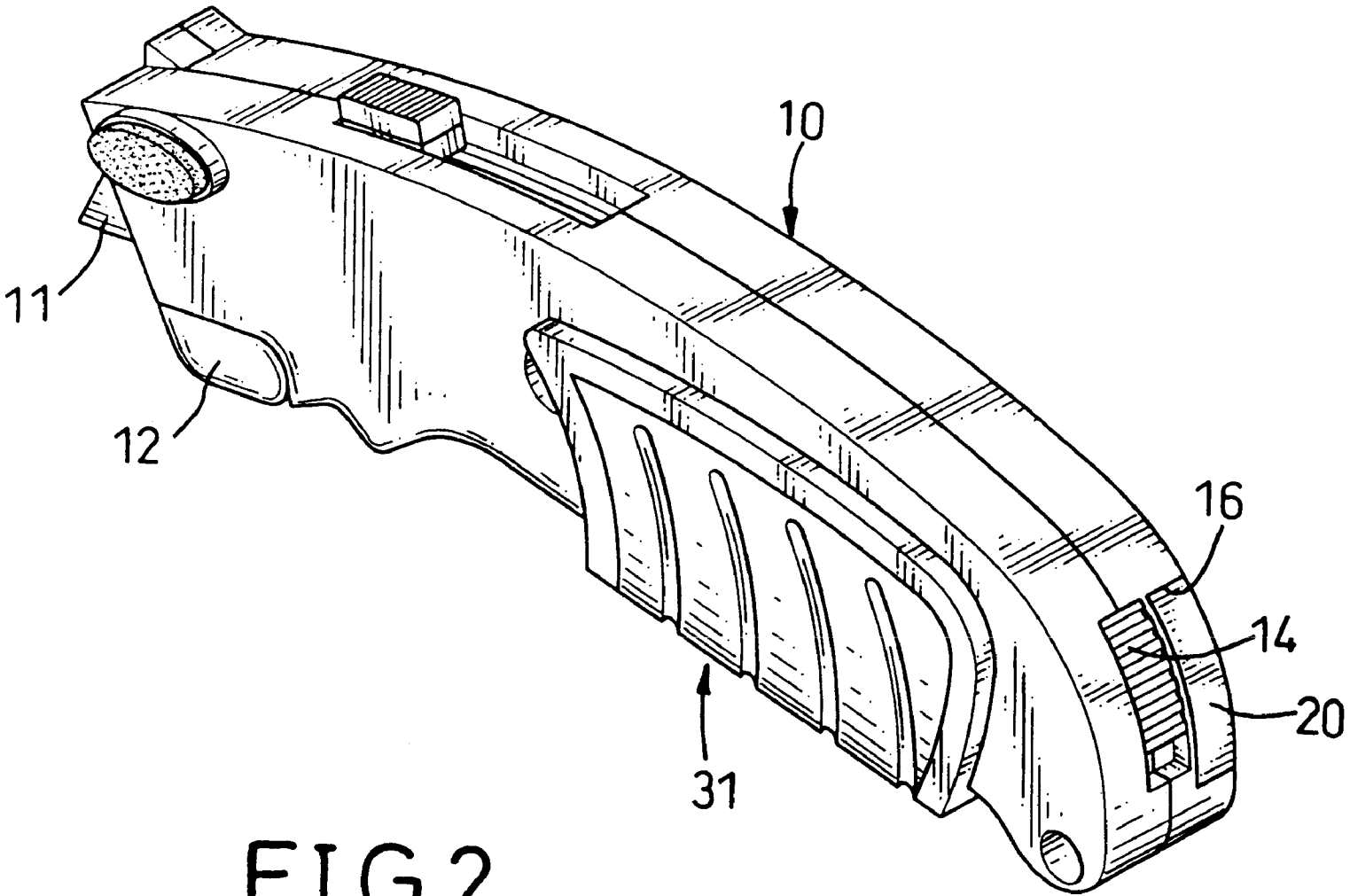
FIG. 2 is a perspective view of the invention.

Shown in FIGS. 1 and 2 is the invention, an illuminating utility knife with an easy-access spare blade drawer. The utility knife has a housing (10) made up of a first cover (101) and a second cover (102) coupled together and fastened by a screw. The housing (10) is roughly divided into two sections: a front room and a rear room. A blade (11) is installed on a control assembly (not shown) slidably contained in the front room. By moving a button of the control assembly, a user can move the blade (11) with respect to the housing (10). However, the control assembly is conventional, does not form part of the claimed invention, and thus is not described in further detail. Furthermore, a knob (not numbered) in communication with the front room enables easy replacement of the blade (11) but as this is conventional and does not form part of the claimed invention, further description thereof is omitted. A bulb (13) is installed in a front end of the housing (10) and below the blade (11). A lampshade (12) is pivotally secured to the front end of the housing (10) and below the bulb (13), whereby the bulb (13) can be shaded.

A battery chamber (17) is defined in the first cover (101) and is able to contain at least one battery (30). A spare bulb recess (18) is defined near the battery chamber (17) and able to contain at least one spare bulb (13A). A passage (15) is defined in the second cover (102) and communicates with a side wall of the second cover (102) forming a mouth (16). A spare blade drawer (20) is inserted into the passage (15) from the mouth (16). The spare blade drawer (20) has a spare blade recess (22) being able to contain one or more spare blades (11A). The spare blade drawer (20) has a face panel (21) such that when the spare blade drawer (20) is pushed to an innermost position in the passage (15), the face panel (21) thereof can form a completed and harmonious outline with the whole housing (10). The battery chamber (17) and the passage (15) are both formed in the rear room of the housing.

A U-shaped cover (31) having a pair of side plates (33) and a certain degree of elasticity is provided for securing in place the battery (30) and the spare bulb (13A) in the battery chamber (17) and the spare bulb recess (18) respectively. The U-shaped cover (31) has a head (32) having a traverse hole. A pin (19) is inserted through the hole in the head (32) and then fixed to the housing (10). The U-shaped cover (31) is therefore able to pivot about the pin (19). As especially shown in FIG. 2, when the U-shaped cover (31) is rotated to cover part of the housing (10), it can block the battery (30) and the spare bulb (13A) from falling out from the battery chamber (17) and the spare bulb recess (18) respectively. The two side plates (33) can sandwich the housing (10) with a certain force to keep the U-shaped cover (31) stable with the housing (10).

Figure 3:
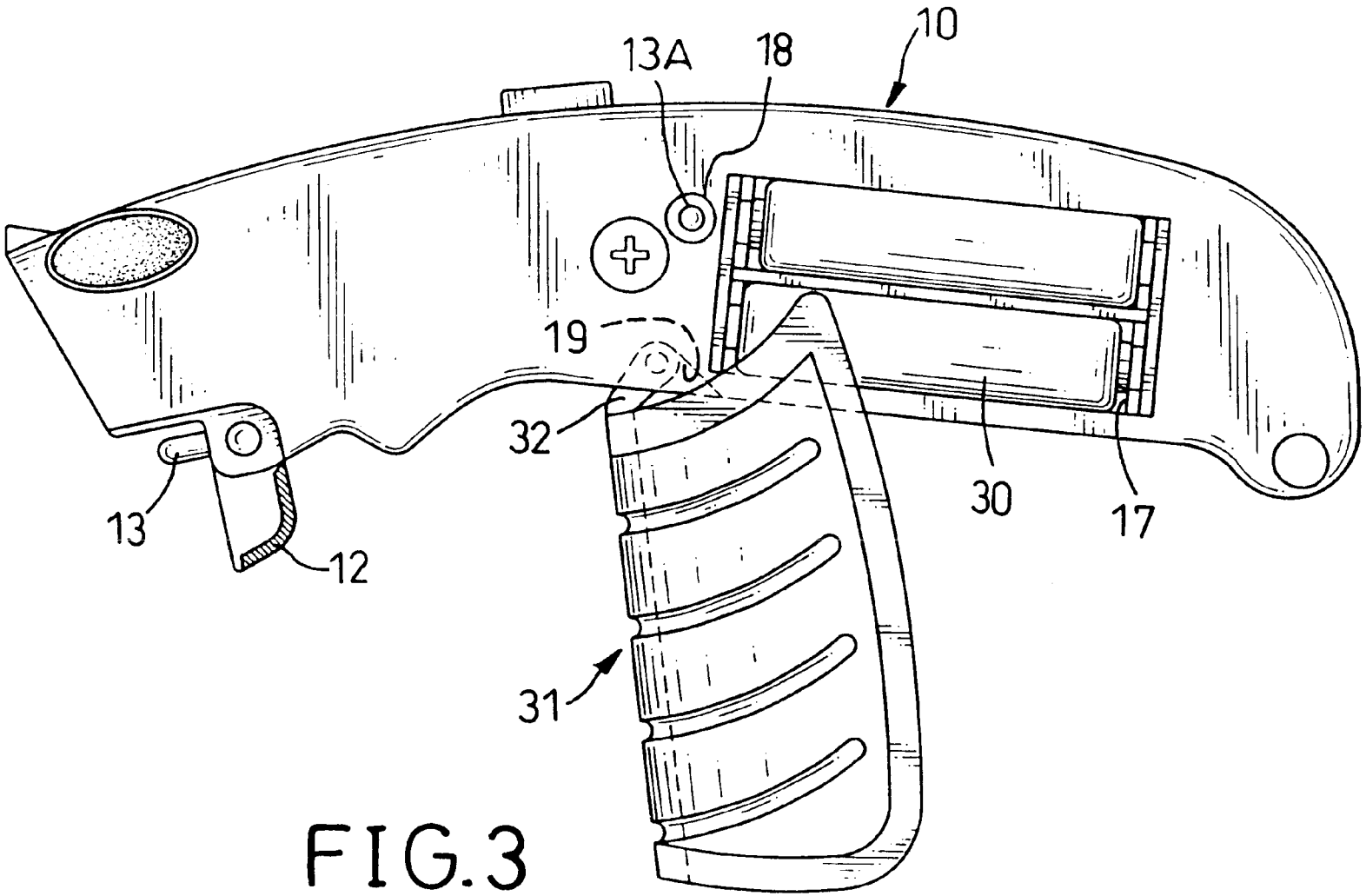
FIG. 3 is a side view of the invention showing a situation where the U-shaped cover is opened.

As shown in FIG. 3, the U-shaped cover (31) can be rotated downward relative to the housing (10) to expose the battery chamber (17) and the spare bulb recess (18). At this time, the spare bulb (13A) can be taken out for use or the battery (30) can be replaced.

Figure 4:
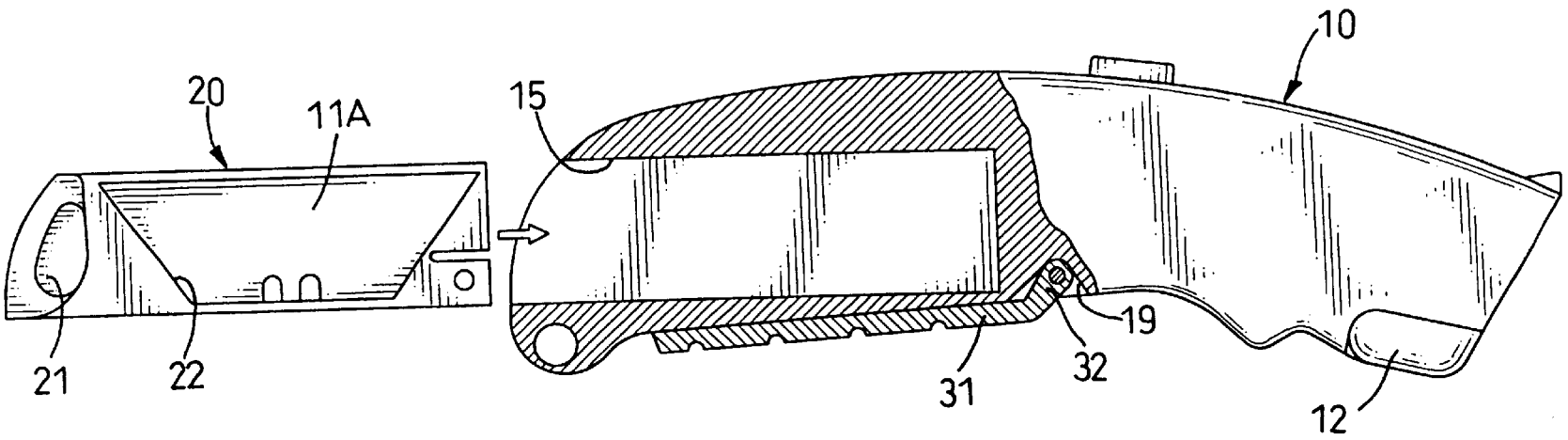
FIG. 4 is a partially cross sectional view of the invention showing the operation of the spare blade drawer; and, FIG. 5 is an exploded view of a present utility knife.
Figure 5:
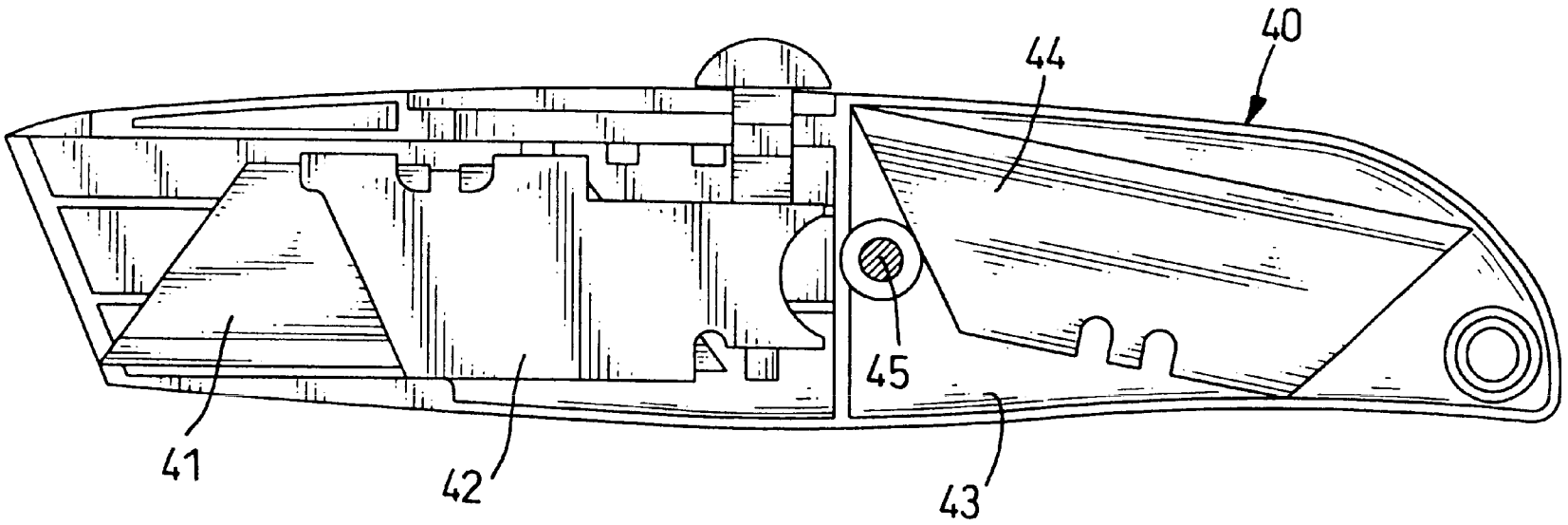
FIG. 5 PRIOR ART

As shown in FIG. 4, the spare blade drawer (20) is slidable with respect to the passage (15). A dimple (21) can be defined in a head of the spare blade drawer (20) whereby a user can use a finger to press on the dimple (21) to easily move the spare blade drawer (20).

Referring back to FIG. 1, a switch (14) is installed in the housing to control the actuation of the bulb (13). Installation and electrical connection of the bulb (13), the battery (30), and the switch (14) are conventional, and will not be described in detail herein. The lampshade (12) can be removed or pivotally lifted away from the front end of the housing (10) for replacement of the bulb (13) and then refitted to the housing (10) to cover the bulb (13) again.

From above description, it is to be understood that with the utility knife of the invention, a user can conveniently take out a spare blade for use, and conveniently use the knife in a dimly-lit environment. It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illuminating utility knife with easy access to spare blades contained therein, the utility knife having a housing made up of a first cover and a second cover coupled and fastened together, the housing being divided substantially into a front room and a rear room, a blade slidably and replaceably contained in the front room of the housing, wherein the improvements comprising:

a spare blade drawer slidably disposed in a passage defined in the second cover, the passage being in open communication with an outer periphery of the second cover to form a month, the spare blade drawer being inserted into the passage via the mouth and having at least one spare blade therein and a dimple defined in an end of the spare blade drawer for use in extracting and inserting the spare blade drawer;

an illuminating device including a bulb installed near the blade, a battery chamber for containing at least one battery defined in the first cover and in open communication with an outer periphery of the first cover, and a switch for actuation of the bulb;

a U-shaped cover pivotally linked to the housing and having a pair of side plates, the side plates of the U-shaped cover being engaged over a portion of the outer periphery of the first and second covers to thereby enclose the battery chamber, the U-shaped cover being rotatable to displace the side plates away from the outer periphery of the first and second covers to expose the battery chamber and enable replacement of the at least one battery.

2. The illuminating utility knife as claimed in claim 1, wherein a lampshade is provided whereby the bulb can be shaded by the lampshade.

3. The illuminating utility knife as claimed in claim 1, wherein a spare bulb recess is defined in the housing for containing at least one spare bulb, and when the U-shaped cover is fully mounted the housing, the spare bulb recess is blocked, whereas when the U-shaped cover is rotated away from the housing, the bulb recess is exposed and the spare bulb can be taken out.

4. An illuminating utility knife with easy access to spare blades contained therein, the utility knife having a housing made up of a first cover and a second cover coupled and fastened together, the housing being divided substantially into a front room and a rear room, a blade slidably and replaceably contained in the front room of the housing, wherein the improvements comprising:

the second cover having a passage defined therein, the passage being in open communication with an outer periphery of the second cover to form a month;

a spare blade drawer slidably disposed in the passage, the spare blade drawer being inserted into the passage in the second cover via the mouth and having at least one spare blade therein;

an illuminating device including a bulb installed near the blade, at least one battery and a switch for actuation of the bulb, the first cover having a battery chamber formed therein for containing the at least one battery, the battery chamber being in open communication with an outer periphery of the first cover, the first cover having a spare bulb recess formed therein and spaced from the battery chamber, the spare bulb recess being in open communication with the outer periphery of the first cover;

a spare bulb disposed in the spare bulb recess; and;

a U-shaped cover pivotally linked to the housing and having a pair of side plates, the side plates of the U-shaped cover being engaged over a portion of the outer periphery of the first and second covers to thereby enclose the battery chamber and the spare bulb access, the U-shaped cover being rotatable to displace the side plates away from the outer periphery of the first and second covers to expose the battery chamber and spare bulb recess and thereby enable replacement of the at least one battery and removal of the spare bulb.

* * * * *